United States Patent [19]

Hara et al.

[11] 4,374,721

[45] Feb. 22, 1983

[54] ROLL HAVING LOW VOLUME RESISTIVITY FOR ELECTROPLATING

[75] Inventors: Yoshio Hara, Zama; Yoshiaki Hashimoto, Kisarazu, both of Japan

[73] Assignees: Mitsubishi Steel Mfg. Co., Ltd.; Nippon Steel Corporation, both of Japan

[21] Appl. No.: 305,398

[22] Filed: Sep. 25, 1981

[30] Foreign Application Priority Data

Sep. 29, 1980 [JP] Japan ..... 55-134399

[51] Int. Cl.[3] ..... C25D 17/10

[52] U.S. Cl. ..... 204/293; 29/132; 204/206; 204/212; 204/216; 204/280; 204/292

[58] Field of Search ..... 204/212, 280, 292, 293, 204/216, 206–211; 29/132

[56] References Cited

U.S. PATENT DOCUMENTS

| | | | |
|---|---|---|---|
| 1,836,317 | 12/1931 | Franks | 75/171 H |
| 3,203,792 | 8/1965 | Scheil et al. | 148/162 X |
| 3,674,656 | 7/1972 | Yates | 204/13 |
| 3,870,618 | 3/1975 | Seyb et al. | 204/28 |
| 3,918,964 | 11/1975 | Baldwin et al. | 75/171 |
| 3,942,230 | 3/1976 | Nalband | 29/132 |
| 4,064,608 | 12/1977 | Jaeger | 29/132 |
| 4,318,794 | 3/1982 | Adler | 204/216 |

FOREIGN PATENT DOCUMENTS

| | | | |
|---|---|---|---|
| 457040 | 5/1949 | Canada | 204/206 |
| 45-14665 | 5/1970 | Japan . | |
| 53-37814 | 10/1978 | Japan . | |

OTHER PUBLICATIONS

ASTM Designation: B 334–71.

Aeronautical Material Specification: AMS 5389A.

*Primary Examiner*—F. Edmundson

[57] ABSTRACT

A roll for electroplating having low volume resistivity is provided which consists essentially of, in wt %, below 0.1% C, below 1.5% Si, below 1.5% Mn, 14% to 21% Cr, 13% to 20% Mo, below 6% Fe, and the balance substantially Ni. The roll may further contain one or more of the elements selected from the group consisting of below 0.5% Al, below 1.0% Ti, below 1.5% Nb, below 0.5% V, and below 3.0% W.

2 Claims, 1 Drawing Figure

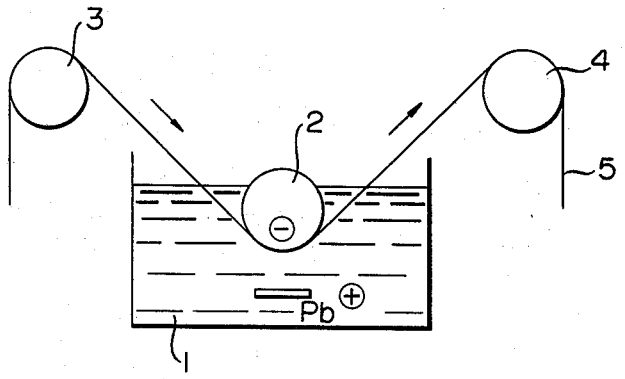
3
4
2
5
Pb
1

ROLL HAVING LOW VOLUME RESISTIVITY FOR ELECTROPLATING

BACKGROUND OF THE INVENTION

The present invention relates to a roll and more particularly to a roll having low volume resistivity for electroplating.

Hitherto, as a roll having low volume resistivity for electroplating, some corrosion resistant steels such as those defined in the Japanese Industrial Standard under the classifications "JIS-SCS14", "JIS-SUS316", etc. have been used, but these corrosion resistant steels are inferior in resistivity to corrosion due to electric current flowing therethrough and to erosion by acidic solutions, etc. as well as in wear resistance. Therefore, a remarkable surface roughening occurs on the roll surface so that the roll is required to be ground within a relatively short period of time, e.g. every one week, in order to continue to be usable.

SUMMARY OF THE INVENTION

It is a principal object of the present invention to provide a roll for electroplating having low volume resistivity and overcoming all of the defects above described inherent in the conventional corrosion resistant steels such as those defined by "JIS-SCS14", "JIS-SUS316", etc.

It is another object of the present invention to provide a roll for electroplating having low volume resistivity which does not affect the electric current flow and is superior in resistivity under the severe condition of the large electric current flow for electroplating zinc, tin, etc. and which has great hardness, toughness and strength, and also excellent wear resistance.

In accordance with the present invention, a roll for electroplating having low volume resistivity is provided which consists essentially of, in weight %, below 0.1%C, below 1.5%Si, below 1.5%Mn, 14 to 21%Cr, 13 to 20%Mo, below 6%Fe, and the balance substantially Ni.

According to one aspect of the present invention, a roll for electroplating having low volume resistivity contains further one or more elements selected from the group consisting of below 0.5%Al, below 1.0%Ti, below 1.5%Nb, below 0.5%V and below 3%W.

BRIEF DESCRIPTION OF THE DRAWING

These and other objects of the present invention will become more readily apparent upon reading the following specification and upon reference to the accompanying drawing which is an explanatory representation showing a method for testing the corrosion- and wear-resistance of a roll for electroplating.

DESCRIPTION OF THE PREFERRED EMBODIMENTS

As stated above, the roll according to the present invention is characterized in that it consists mainly of Ni with Mo and Cr being added thereto as fundamental elements in specific amounts. Also as will be explained fully later, the roll according to the present invention is subjected, after it has been shaped, to a solid solution heat treatment so as to make the anstenite base structure uniform in order to reveal both the corrosion resistivity and the wear resistivity.

First the reasons why in the present invention the specific chemical components and their specific ranges have been selected will be explained below.

Ni is selected as the basic component of the roll to make the matrix of the roll an austenite structure to stabilize it. Further, since Ni itself is low in ionisation tendency its speed of dissolution due to corrosion is low and the coating produced by corrosion is minute, revealing a high protective property and exhibiting excellent passivity. Cobalt contained in the nickel as an impurity is allowable up to 2.5 wt%.

Mo, in association with Ni, reduces the speed of dissolution due to corrosion as its content increases, increasing passivity and remarkably improving corrosion resistance. This corrosion resistance is revealed first when the amount added becomes greater than 13 wt%, but saturated at the addition of more than 20 wt%, intermetallic compounds easily precipitating and adversely affecting the corrosion resistance.

Cr has a small speed of dissolution due to corrosion and forms a matrix together with Ni and Mo having passivity to produce a stronger protective coating and provide passivity. In the present roll, the addition of Cr reveals its effect remarkably when it becomes greater than 14 wt%, but becomes saturated at the addition of more than 21 wt%, the occurrence of intermetallic compounds making the roll brittle and also deteriorating the corrosion resistance.

Although C, Si and Fe are inevitally contained during the production of the roll, they are preferably as low as possible. However, since C, depending upon its amount, precipitates as carbide and deteriorates the corrosion resistance, its content is preferably below 0.06 wt%; however, even if the carbon content is as high as 0.1 wt%, the roll can be made satisfactory by subjecting it to a complete solid solution heat treatment.

However, in order to stabilize this excessive carbon, the addition of some elements such as Ti, Nb, etc. is effective. For this purpose, the Ti and Nb must satisfy the following relationships relative to the carbon content: $Ti \geqq 5 \times Cwt\%$, and $Nb \geqq 10 \times Cwt\%$, whereby Ti and Nb are limited to below 1.0 wt% and 1.5 wt%, respectively, at the most.

The addition of Si, depending upon its quantity, may precipitate intermetallic compounds, but deterioration of the corrosion resistance can be avoided by subjecting the roll to a complete solid solution heat treatment. Although the amount of Si varies with the manufacturing process of the roll, addition below 1.5% is necessary from the stand point of deoxidation, fluidity of melt, etc.

In order to avoid the precipitation of the intermetallic compounds, in place of Si other deoxidation elements such as Al may be effectively used within a range not affecting the manufacture. The effective amount of Al is below 0.5 wt%.

As to Fe, so long as its content is below 6 wt%, although deterioration in the corrosion resistance may be revealed to some extent, it has little effect on the properties of the roll.

Mn has no large effect on the properties of the roll, but it broadens the range of the $\gamma$-phase, stabilizing it, and improves hot workability. The amount of Mn is to be below 1.5 wt%.

The addition of V below 0.5 wt% refines the grain and somewhat hardens the roll, improving wear resistance, but if the content becomes greater than 0.5 wt% deterioration in the corrosion resistance will occur.

Finally, as to W, it improves corrosion resistance and increases strength as Mo does, but if the content exceeds 3 wt% intermetallic compounds are easily precipitated. In order to obtain a uniform structure a solid solution heat treatment at a temperature of 1,220° C. is necessitated. Therefore, the amount is limited to below 3 wt%.

Next several embodiments of the roll for electroplating having low volume resistivity according to the present invention will be explained in reference to the results of experiments carried out for comparison with conventional rolls.

Table 1 shows the chemical components (wt%) of various test rolls, Table 2 showing the results of the corrosion and wear resistance tests carried out under the flow of an electric current through the test rolls, as well as the mechanical properties. The experiments took place such that, as shown schematically in the attached drawing, a test roll 2 was immersed in a solution 1 comprising 30%$ZnSO_4$+3%$H_2SO_4$, the pH being 1.2, and a mild steel strip 5 was wound around test roll 2 as well as a brake roll 3 and a drive roll 4 arranged outside solution 1, steel strip 5 being continuously moved in the direction shown by the arrows under a definite tension with an electric current flowing from an anode of Pb to test roll 2 at a current density of 20 A/dm$^2$. The results of corrosion and wear resistance tests were judged by the roll life ratio and the flaw generation ratio, defined below. That is, the roll life ratio was defined as the weight reduction of the test roll, expressed by the ratio of the weight reduction of the test roll to the weight reduction of the test roll made of JIS-SUS316, assuming the latter to be 1.0. The flaw generation ratio was defined as the number of flaws such as scratches, indents, etc. generated on the surface of the test roll due to mechanical reasons after continuous operation for a week, expressed by the ratio of the number of said flaws on the test roll to the number of flaws on the test roll made of JIS-SUS316, assuming the latter to be 100.

In Table 2 also the results of corrosion tests carried out on some of the rolls cast according to the present invention are shown.

Among the test rolls shown in Table 1, test roll Nos. 1 to 4, 9, and 14 to 17 in accordance with the present invention are those in which the contents of the fundamental elements, Ni, No and Cr, were changed. Similarly, Nos. 5 to 8 and 10 to 13 are those in which, in addition to the fundamental elements, Al, Ti Nb and V were added singularly or in combination, i.e. Al was added to avoid the precipitation of intermetallic compounds due to Si; Ti or Nb was added to avoid the precipitation of carbide due to C; and V was added to refine the grain.

As apparent from Table 2, in the roll in accordance with the present invention, in comparison with the conventional roll using JIS-SUS316, the corrosion and wear resistance is 9 to 12 times that of the latter in terms of the roll life ratio. The flaw generation ratio is between 1/2.5 and 1/4 times that of the conventional roll, presumably due to no occurrence of scratches, etc. on the roll surface owing to the superiority of mechanical properties. Although the volume resistivity of the test rolls according to the present invention is 130 $\mu\Omega$cm, inferior to the 74 $\mu\Omega$cm of that of JIS-SUS316, since a volume resistivity up to 170 $\mu\Omega$cm has been deemed to be satisfactory, this is not a serious problem.

On studying Table 2, among test roll nos. 1 to 4, 9, and 14 to 17, wherein the fundamental compositions are changed, it is apparent that test roll no. 4, which contains Cr in an amount in the middle of the range and Mo in an amount at the upper limit of the range, and test roll no. 9 which contains both Cr and Mo in amounts in the middle of the respective ranges, exhibit excellent properties, and, compared with JIS-SUS316, roll life ratios of 11.5 and 12 are respectively obtained, the flaw generation ratio being as low as 1/3 compared with a conventional roll.

Test roll nos. 5 and 10, in which the content of Si is reduced but Al added, and Ti is added to stabilize C, respectively, and test roll nos. 6 and 11, in which Nb is added, exhibit roll life ratios of 11.5 and 12 compared with JIS-SUS316. These results show that the roll life ratios of these test rolls do not substantially differ from that of test roll nos. 4 and 9, which contain the fundamental elements, i.e. do not exhibit an effect of the addition of Al and (or) Ti and (or) Nb. However, the results, represented by a corrosion amount in g/cm$^2$/day, of the immersion tests of the test rolls as cast immersed in a boiling 50%$H_2SO_4$ solution and in a boiling 20%HCl solution show, as shown in Table 2, that test roll nos. 5 and 10, and 6, and 11 have superior properties to test roll nos. 4, 9, which contain merely the fundamental elements, and these results teach the fact that the addition of Al, Ti or Nb singularly or in combination is effective in cases where repair by welding is carried out, or a quick cooling treatment cannot take place after a solid solution heat treatment.

As to test roll nos. 7 and 12, in which V is added, they show a roll life ratio of 11 compared with JIS-SUS316, and a flaw generation ratio of 1/4 compared with JIS-SUS316. However, no notable differences in mechanical properties can be recognized between the other test rolls.

From the foregoing, it will be appreciated that although the roll according to the present invention pertains to a Ni-Mo-Cr base roll so far as its fundamental elements are concerned, it has satisfactory corrosion resistance even when it is placed under severe corrosive conditions such as an electric current being flowed therethrough while it is immersed in a corrosive solution. Therefore, the roll in accordance with the present invention can be used in a corrosive solution having a pH value of 0.6 to 1.8, under the flow of an electric current, conditions the rolls made of JIS-SCS14 or JIS-SUS316 could never resist. The present roll however exhibits excellent corrosion resistance in particularly severe conditions such as a pH value of 0.6 to 1.8. Moreover, since the roll in accordance with the present invention also has superior mechanical properties it has not only sufficient wear resistance, but also a satisfactory low volume resistivity, allowing its practical use for a longer period without exhibiting any problems.

Thus, the present invention provides a most appropriate roll having low volume resistivity for electroplating, which indispensably requires such excellent properties.

Finally, it will be appreciated that although the present invention has been explained above solely with regard to the material therefor, concerning its shape, the roll in accordance with the present invention can have any desired shape and dimension and the superior properties as explained above are revealed regardless of the shape and dimension of the roll.

TABLE 1

TEST ROLLS

| Classification | | Chemical Composition (wt %) C | Si | Mn | Cr | Mo | Fe | Ni | Ti | Nb | V | Al | W |
|---|---|---|---|---|---|---|---|---|---|---|---|---|---|
| Conventional Rolls | JIS-SCS14 | 0.06 | 1.63 | 1.54 | 19.13 | 2.34 | balance | 12.48 | — | — | | | |
| | JIS-SCS316 | 0.04 | 0.82 | 1.53 | 17.03 | 2.52 | balance | 12.35 | — | — | | | |
| Examples of the Rolls in accordance with the Present Invention | No. 1 | 0.03 | 0.83 | 0.63 | 15.02 | 17.10 | 1.50 | balance | — | — | — | — | — |
| | No. 2 | 0.04 | 0.79 | 0.59 | 16.07 | 18.02 | 1.23 | balance | — | — | — | — | — |
| | No. 3 | 0.03 | 0.68 | 0.62 | 15.97 | 15.03 | 1.63 | balance | — | — | — | — | — |
| | No. 4[1] | 0.03 | 0.89 | 0.54 | 17.51 | 19.07 | 1.96 | balance | — | — | — | — | — |
| | No. 5 | 0.04 | 0.34 | 0.69 | 17.42 | 18.97 | 1.82 | balance | 0.38 | — | — | 0.09 | — |
| | No. 6 | 0.04 | 0.36 | 0.52 | 17.53 | 19.02 | 1.63 | balance | — | 0.57 | — | 0.07 | — |
| | No. 7 | 0.03 | 0.82 | 0.64 | 17.62 | 19.09 | 2.05 | balance | — | — | 0.35 | — | — |
| | No. 8 | 0.04 | 0.84 | 0.53 | 17.46 | 18.94 | 2.17 | balance | — | — | — | — | 1.31 |
| | No. 9[2] | 0.03 | 0.82 | 0.49 | 17.46 | 16.53 | 1.63 | balance | — | — | — | — | — |
| | No. 10 | 0.04 | 0.32 | 0.68 | 17.53 | 16.49 | 1.54 | balance | 0.32 | — | — | 0.08 | — |
| | No. 11 | 0.05 | 0.29 | 0.48 | 17.48 | 16.59 | 1.96 | balance | — | 0.56 | — | 0.09 | — |
| | No. 12 | 0.03 | 0.79 | 0.53 | 17.59 | 16.55 | 1.86 | balance | — | — | 0.38 | — | — |
| | No. 13 | 0.04 | 0.76 | 0.56 | 17.42 | 16.62 | 1.72 | balance | — | — | — | — | 1.52 |
| | No. 14 | 0.03 | 0.91 | 0.57 | 17.53 | 13.98 | 1.74 | balance | — | — | — | — | — |
| | No. 15 | 0.03 | 0.82 | 0.53 | 19.02 | 18.10 | 1.59 | balance | — | — | — | — | — |
| | No. 16 | 0.04 | 0.84 | 0.49 | 18.98 | 15.13 | 1.52 | balance | — | — | — | — | — |
| | No. 17 | 0.05 | 0.82 | 0.51 | 20.13 | 16.49 | 2.04 | balance | — | — | — | — | — |

Note:
[1]Test roll No. 4 contains Cr in an amount in the middle of the range and Mo in an amount at the upper limit of the range.
[2]Test roll No. 9 contains Cr and Mo both in amounts in the middle of the respective ranges.

TABLE 2

TEST RESULTS[1]

| Classification | | Corrosion- and Wear-Resistance: Roll Life Ratio | Flaw Generation Ratio | Corrosion Amount: g/cm²/day[2]: Boiling 50% × $H_2SO_4$ | Boiling 20% HCl | Volume Resistivity μΩcm | Mechanical Properties: 0.2% Proof Strength Kg/mm² | Tensile Strength Kg/mm² | Elongation % | Hardness |
|---|---|---|---|---|---|---|---|---|---|---|
| Conventional Rolls | JIS-SCS14 | 0.9 | 100 | — | — | ↑ 74 | 32.2 | 61.3 | 49.7 | 82 |
| | JIS-SCS316 | 1.0 | 100 | — | — | ↓ | 21.7 | 56.3 | 54.2 | 78 |
| Examples of the Rolls in accordance with the Present Invention | No. 1 | 9 | 35 | — | — | ↑ | 30.5 | 64.5 | 49.2 | 91 |
| | No. 2 | 10 | 30 | — | — | ↑ | 31.2 | 65.3 | 46.2 | 92 |
| | No. 3 | 10 | 40 | — | — | ↑ | 30.5 | 63.5 | 45.8 | 91 |
| | No. 4 | 11.5 | 30 | 0.170 | 0.320 | ↑ | 34.3 | 67.6 | 45.2 | 94 |
| | No. 5 | 11.5 | 30 | 0.120 | 0.205 | ↑ | 33.2 | 66.5 | 44.2 | 94 |
| | No. 6 | 11.5 | 30 | 0.130 | 0.220 | 130 | 32.1 | 68.2 | 45.6 | 94 |
| | No. 7 | 11 | 25 | — | — | ↓ | 33.9 | 69.9 | 44.2 | 94 |
| | No. 8 | 11 | 25 | — | — | ↓ | 34.6 | 69.2 | 43.2 | 95 |
| | No. 9 | 12 | 30 | 0.125 | 0.270 | ↓ | 31.3 | 65.9 | 47.2 | 92 |
| | No. 10 | 12 | 30 | 0.100 | 0.165 | ↓ | 30.2 | 65.3 | 46.8 | 92 |
| | No. 11 | 12 | 30 | 0.900 | 0.185 | ↑ | 30.5 | 65.2 | 45.2 | 92 |
| | No. 12 | 11 | 25 | — | — | ↑ | 31.8 | 67.2 | 47.1 | 92 |
| | No. 13 | 11 | 25 | — | — | ↑ | 32.5 | 64.7 | 46.2 | 92 |
| | No. 14 | 9 | 40 | — | — | 130 | 31.5 | 63.8 | 45.6 | 91 |
| | No. 15 | 11 | 30 | — | — | ↓ | 35.2 | 68.2 | 44.8 | 94 |
| | No. 16 | 11 | 40 | — | — | ↓ | 34.3 | 67.9 | 46.2 | 94 |
| | No. 17 | 10 | 25 | — | — | ↓ | 36.2 | 69.3 | 40.1 | 95 |

Note:
[1]In the Table, the results obtained for test rolls which have been solid solution heat treated through rapid cooling from a temperature of 1,150° C. are listed.
[2]The corrosion amounts are the results obtained by immersing specimens as cast within the solutions above described, respectively.

What is claimed is:

1. A roll for electroplating having low volume resistivity consisting essentially of, in weight %, below 0.1%C, below 1.5%Si, below 1.5%Mn, 14% to 21%Cr, 13% to 20%Mo, below 6%Fe, and the balance substantially Ni.

2. A roll for electroplating having low volume resistivity as claimed in claim 1 wherein said roll further contains one or more elements selected from the group consisting of below 0.5%Al, below 1.0%Ti, below 1.5%Nb, below 0.5%V and below 3.0%W.

* * * * *